United States Patent [19]

Kostylev et al.

[11] 4,160,486

[45] Jul. 10, 1979

[54] PNEUMATIC IMPACT MECHANISM

[76] Inventors: Alexandr D. Kostylev, ulitsa Derzhavina, 19, kv. 70; Boris N. Smolyanitsky, ulitsa Oleko Dundicha, 27, kv. 18; Vladimir P. Boginsky, ulitsa Lenina, 59, kv. 58; Konstantin S. Gurkov, ulitsa Derzhavina, 18, kv. 13; Vladimir V. Klimashko, ulitsa Novogodnyaya, 44, kv. 24, all of Novosibirsk, U.S.S.R.

[21] Appl. No.: 789,864

[22] Filed: Apr. 22, 1977

[30] Foreign Application Priority Data

Apr. 24, 1976 [SU] U.S.S.R. ..... 2356969

[51] Int. Cl.[2] ..... E21B 1/00

[52] U.S. Cl. ..... 173/135; 173/91

[58] Field of Search ..... 173/134, 135, 91, 92

[56] References Cited

U.S. PATENT DOCUMENTS

| | | | |
|---|---|---|---|
| 1,463,785 | 8/1923 | Annison | 173/136 |
| 3,920,086 | 11/1975 | Goppen | 173/134 |
| 3,952,813 | 4/1976 | Chepurnoi | 173/91 |
| 3,955,478 | 5/1976 | Feucht | 173/134 |
| 3,995,702 | 12/1976 | Kumashko et al. | 173/91 |

*Primary Examiner*—Robert A. Hafer

*Attorney, Agent, or Firm*—Robert E. Burns; Emmanuel J. Lobato; Bruce L. Adams

[57] ABSTRACT

A pneumatic impact mechanism for driving rod-like members having a hollow cylindrical casing with a tail portion and a front end portion. The casing accommodates a reciprocating stepped hammer piston defining in the casing, on the tail portion side, a variable volume rear end work chamber in permanent communication with a source of compressed air. The stepped hammer piston defines, on the side of the front end portion, a variable volume front end work chamber.

The stepped hammer piston has a through-passing axial bore, and its small-diameter portion cooperates with the tail portion of the casing and has radial passages. There is provided a tubular guide member or element for receiving the rod-like member arranged coaxially with the stepped hammer piston and casing and secured to the tail portion and to the front end portion of the casing in such a manner as to cooperate with the stepped hammer piston and define therewith, with the outer periphery thereof an axial passage. A clamp for engaging the individual rod-like members is rigidly removably secured to the front end portion of the casing. The front end-work chamber communicates, at regular intervals, with atmosphere through the axial passage and radial bores when the stepped hammer piston is in its rear end position and with the rear end work chamber when the stepped hammer piston is in the front end position to deliver blows to the casing under the action of compressed air fed to the work chambers.

2 Claims, 3 Drawing Figures

PNEUMATIC IMPACT MECHANISM

BACKGROUND OF THE INVENTION

The invention relates to the constructional equipment, and more particularly to pneumatic impact mechanisms for driving rod-like members.

The present invention may be most advantageously used for driving earthing electrodes, anchor rods and similar rod-like members having the diameter which is incommensurably small compared to their length, in soil.

Different types of mechanisms for driving rod-like members in soil are known.

Known in the art is a hydraulically-operated mechanism for driving rod-like earthing or ground electrodes in soil. The mechanism comprises a hydraulic power cylinder having a piston with a hollow piston rod on either side thereof for receiving the electrode to be driven. The upper portion of the cylinder accommodates a guide coaxial with the rod, the guide having a large-pitch helical slot along the entire height thereof. A pin received in the helical slot of the guide is secured to the outer periphery of the piston rod. A self-locking clamp is mounted at the lower, free end of the piston rod. The casing of the power cylinder is secured to an electric transmission line support or to a frame of a constructional machine, such as a tractor, by means of collars. Working fluid may be fed either to the upper or lower chamber of the hydraulic cylinder.

During the initial period of operation, the piston rod is lifted to the upper position, and the electrode is inserted therein so as to bear against the soil. Then fluid is admitted to the upper chamber of the power cylinder, and the piston and the piston rod are displaced downwards. The clamp rigidly grips the electrode to cause its displacement together with the piston rod. While moving downwards, the pin is displaced in the helical slot of the guide to impart an additional rotary motion to the electrode. When the piston reaches the lower position, the fluid is fed in the opposite direction, and the piston rod is caused to move upwards. Thus the clamp releases the electrode and is lifted together with the piston rod without the electrode. After the piston rod reaches the upper position, it starts driving the electrode anew.

The disadvantages of the prior art hydraulically driven mechanism consist in its large size, the need in securing to a massive support or frame of a machine. In addition, it is difficult to drive a rod in compact and frozen soils by using such mechanism because of the static nature of load application to the rod.

Known in the art is also a pneumatic impact tool for driving rod-like members in soil.

The tool comprises a casing having a clamp rigidly secured to the front end portion thereof. The casing accommodates a reciprocating stepped hammer piston. The rear end portion of the casing is sealed by a tail portion having ports for admitting and discharging air. The stepped hammer piston defines a front end work chamber with the casing and a rear end work chamber with the tail portion. The rear end work chamber is in permanent communication with a compressed air source, and the front end work chamber communicates with the rear end work chamber and with atmosphere at regular intervals.

The tool is secured at the top of a rod by means of the clamp. Upon feeding compressed air, the stepped hammer piston reciprocates to deliver blows to the front end portion of the casing. The rod is driven in soil under the action of these blows transmitted thereto through the casing and clamp.

The prior art tool provides for delivery of blows to the end fact of the rod only, so that rods having the cross-sectional dimensions incommensurably small compared to the length thereof cannot be driven due to their deformation during the driving.

Known in the art is also a pneumatic impact mechanism (U.S. Pat. No. 692,388) comprising a hollow cylindrical casing having a tail portion and a front end portion, the casing accommodating a reciprocating stepped hammer piston. The hammer piston defines a variable volume rear end work chamber in the casing on the tail portion side in permanent communication with a compressed air source, and a variable volume front end work chamber on the front end portion side. The front end work chamber communicates, at regular intervals with the rear end work chamber when the stepped hammer piston is in the front end position and with atmosphere, via an axial passage of the hammer piston and radial bores in the periphery of the small-diameter portion of the stepped hammer piston cooperating with the tail portion, when the hammer piston is in the rear end position. The stepped hammer imparts blows to the casing during reciprocations under the action of compressed air admitted to the work chambers.

The stepped hammer piston reciprocates due to the difference in surface areas thereof on the sides of the front end and rear end work chambers under compressed air pressure.

During the driving of rod-like members, the impact mechanism is secured to the upper portion of the rod. The rod is driven in soil under the action of blows imparted to the end face thereof. Thus, this prior art mechanism cannot be used for driving rods having the cross-sectional dimensions incommensurably smaller compared to the length thereof due to their deformation during the driving.

SUMMARY OF THE INVENTION

It is an object of the invention to eliminate the above-mentioned disadvantages of the above-described devices for driving rod-like members in soil.

It is an object of the invention to provide for driving rod-like members having the cross-sectional dimensions incommensurably small compared with the length thereof in compact and frozen soils.

Another object of the invention is to reduce the mass and size of the mechanism.

Still another object of the invention is to improve the reliability of the mechanism.

An additional object of the invention is to simplify construction of the mechanism.

These objects are accomplished by that a pneumatic impact mechanism for driving rod-like members comprising a hollow cylindrical casing having a tail portion and a front end portion, the casing accommodating a hammer piston defining a variable volume rear end work chamber in the casing on the tail portion side in permanent communication with a compressed air source and a variable volume front end work chamber communicating, at regular intervals, with the rear end work chamber when the stepped hammber piston is in the front end position and with atmosphere, via an axial passage of the hammer piston and radial bores made in the periphery of the small-diameter portion of the stepped hammer piston, when the stepped hammer piston is in the rear end position, the hammer piston delivering blows to the casing during its reciprocations therein under the action of compressed air admitted to the work chambers, according to the invention, is provided with a tubular guide member for receiving the rod-like member, the tubular guide member being arranged coaxially with the stepped hammer piston and the casing and secured to the tail portion and to the front end portion of the casing, the tubular guide member cooperating with the stepped hammer piston so that the outer periphery of the tubular member defines an axial passage with the hammer piston, and a clamp is rigidly secured to the front end portion of the casing for retaining the rod-like member therein.

This construction of the pneumatic impact mechanism enables the insertion of the rod-like member having the cross-sectional dimensions incommensurably small compared to the length thereof in the tubular guide member and fixation of the impact mechanism at a distance from the end face of the rod-like member such as to avoid the deformation of the rod-like member during the driving.

BRIEF DESCRIPTION OF THE DRAWINGS

The invention will now be described with reference to a preferred embodiment thereof illustrated in the accompanying drawings, in which.

DESCRIPTION OF THE PREFERRED EMBODIMENT

Figure 1:
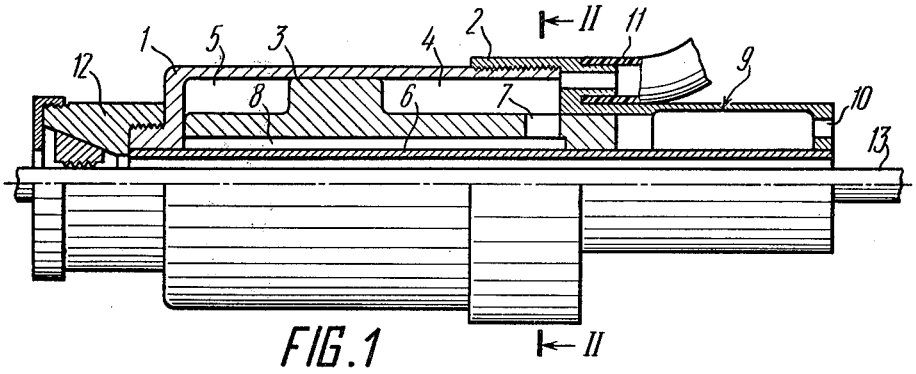
FIG. 1 is a side elevation view, partly in section of the pneumatic impact mechanism according to the invention, partially in section, the hammer piston being illustrated in the front end position.

FIG. 1 shows a practical embodiment of the invention illustrating the pneumatic impact mechanism (in longitudinal section) with the hammer piston in the front end or forward end position. The pneumatic impact mechanism is designed for driving individually rod-like members.

Figure 2:
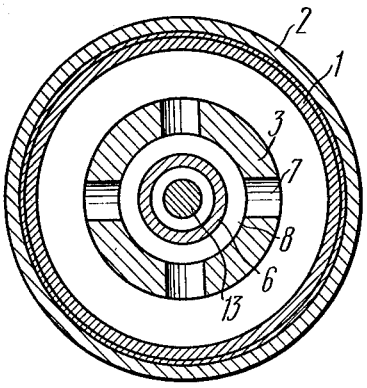
FIG. 2 is a sectional view taken along section line II—II in FIG. 1.

The pneumatic impact mechanism according to the invention comprises a hollow cylindrical casing 1 (FIGS. 1,2) having a tail or rear portion or extension 2 and a front end portion. The tail portion 2 comprises a stepped bushing which is threaded to the end portion of the casing 1 and seals the inner space of the casing 1. The casing 1 accommodates a reciprocating stepped hammer piston 3. A large-diameter or major diameter portion of the hammer piston 3 is located adjacent to the front end portion of the casing 1, and the outer periphery thereof engages the inner surface of the casing 1. The smaller or minor diameter portion is received in an axial bore of the tail portion or extension 2 in such a manner that the outer periphery of this portion engages the inner surface of the axial bore of the tail portion 2.

When in the front end position (FIG. 2), the stepped hammer pistion 3 defines, in the casing 2, a variable volume rear end work chamber 4 on the side of the tail portion 2. The chamber 4 is formed by the end face of the large-diameter portion of the hammer piston 3 facing the tail portion 2, the outer periphery of the small-diameter portion, the inner surface of the casing 1 and the end face of the tail portion 2. The rear end work chamber 4 permanently communicates with a compressed air source (not shown).

On the side of the front end portion of the casing 1, the stepped hammer piston 2 defines a variable volume front end work chamber 5. The chamber 5 is defined by the periphery of the large-diameter portion of the stepped hammer piston 3 facing the front end portion of the casing 1 and the inner surface of the casing 1.

An axial bore is made in the stepped hammer piston 3 receiving a tubular guide member 6 for insertion of a rod-like member. The tubular guide member 6 is mounted coaxially with the stepped hammer piston 3 and casing 1, extends along the entire length of the casing 1 and is secured to the tail portion or extension 2 and to the front end portion of the casing 1.

The small-diameter portion of the stepped hammer piston 3 has a zone cooperating with the tubular guide member 6, and the axial bore of the stepped hammer piston 3 is of a larger diameter than that of the tubular guide member 6 in the zone begining from the front end face of the stepped hammer piston 3 and extending to the zone thereof cooperating with the tubular guide member 6.

Radial bores or passages 7 are made in the small-diameter portion of the stepped hammer piston 3 opening at one end into the outer periphery of the small-diameter portion and at the other end, into the axial bore of the stepped hammer piston 3.

The outer periphery of the tubular guide member 6 and the inner surface of the axial passage of the stepped hammer piston 3 define a blind axial passage 8 which connects the front end work chamber 5 to the rear end work chamber 4 via the radial bores 7 when the hammer piston 3 is approximately in the front end position and to a counterbore 9 made in the inner surface of the axial bore of the tail portion or extension 2 communicating with atmosphere through exhaust ports 10 in the end wall of the tail portion 2 when the hammer piston is in the rear end position. Compressed air is fed to the work chambers 4,5 via a hose 11 secured to the tail portion 2.

A clamp 12 of e.g. the collet type is rigidly secured to the front end portion of the casing 1 for retaining a rod-like member 13 therein.

The pneumatic impact mechanism functions in the following manner.

The rod-like member 13 is inserted into the tubular guide member 6. Then the pneumatic impact mechanism is fixed to the rod-like member 13 by means of the clamp 12 at a distance from the lower end of the rod-like member such as to ensure its driving without loss of stability. Subsequently the rod-like member is placed in a position for driving, and compressed air is fed to the work chambers 4,5 by means of an air distribution valve (not shown).

When the stepped hammer piston 3 is approximately in the front end position (FIGS. 1,2), compressed air is admitted to the front end work chamber 5 from the rear end work chamber 4, via the radial bores 7 and the blind axial passage 8. The pressure of compressed air substantially equal to that in the rear end work chamber 4 is built up in the front end work chamber 5. Since the surface area of the stepped hammer piston 3 which is under the compressed air pressure on the side of the front end work chamber 5 is greater than the surface area of the stepped hammer piston subjected to the same pressure on the side of the rear end work chamber 4, the stepped hammer piston 3 starts moving towards the tail portion 2.

After the radial bores 7 are closed by the inner surface of the axial bore of the tail portion 2, the stepped hammer piston 3 continues to move due to the energy of the air expanding in the front end work chamber 5.

Figure 3:
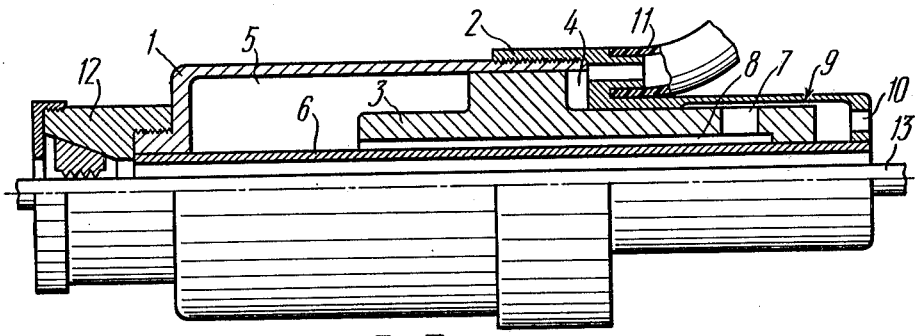
FIG. 3 is a side elevation view of the pneumatic impact mechanism according to the invention, partially in section, the hammer piston being illustrated in the rear end position.

When the stepped hammer piston 3 is in the rear end position (FIG. 3), its radial bores 7 enter the counterbore 9 of the tail portion or extension 2 which extends axially away from the rear chamber and not in communication with either chamber. Thus air is discharged from the front end work chamber 5 through the axial passage 8, radial bores 7 of the stepped hammer piston 3 and exhaust ports 10 of the tail portion 2 into atmosphere.

Air pressure in the front end work chamber 5 drops to atmospheric pressure, the stepped hammer piston 3 is stopped in the rear end position (FIG. 3) and then, under the action of the mains pressure of compressed air in the rear end work chamber 4, starts moving towards the front end portion of the casing 1 to deliver a blow thereto. Prior to the delivery of blow, the radial bores 7 of the stepped hammer piston 3 are opened, and the front end work chamber 5 communicates with the rear end work chamber 4 via the radial bores 7 and the axial passage 8. Then the abovedescribed cycle is repeated.

Under the action of blows imparted to the front end portion 1, the rod-like member 13 rigidly connected to the casing 1 is driven into the soil. After the clamp 12 of the pneumatic impact mechanism 12 reaches the soil surface, the supply of compressed air to the work chambers 4 and 5 is interrupted, and the rod-like member 13 is released from the clamp 12. Then the pneumatic impact mechanism is displaced along the rod-like member 13 upwards, fixed thereto again, and the driving continues.

Contrary to the prior art pneumatic impact mechanisms, the impact mechanism according to the invention enables a blow to be imparted in the zone eliminating deformation of the rod-like member during the driving so that rod-like members having cross-sectional dimensions incommensurably smaller than the length thereof may be driven.

What is claimed is:

1. A pneumatic impact device for driving rod-like elements axially individually comprising, a tubular guide member for receiving individually rod-like elements axially therein to be driven axially; a tubular casing circumferentially of said tubular guide member secured thereto and coaxial therewith defining a cylinder jointly with said guide member; a clamp for rigidly, releasably securing a leading front end portion of the casing to a rod-like element in said guide member; an elongated tubular hammer piston reciprocably driven in said cylinder to effect working strokes and move cyclically from a rear position toward a forward position to said front end portion of said casing and intermittently impact a front end of said casing; said piston having minor diameter portions and a major diameter portion intermediate opposite minor diameter end portions of the piston defining two coaxial, annular chambers in said cylinder on opposite sides of the major diameter portion and varying in volume as the piston moves reciprocably, one of said chambers being closer to a forward end of the cylinder constituting a front chamber and the other chamber constituting a rear chamber; said piston having a blind axial bore open toward said front end of said casing and communicating with said front chamber when said piston moves away from the front end of the casing toward a rear end of the casing; means for supplying an expandible gaseous fluid under pressure into said rear chamber for reciprocably driving said hammber to intermittently impact the front end of the casing to drive the rod-like element axially; a tubular rear extension on said casing extending axially away from said cylinder and not in communication with said cylinder and into which a rear end portion of said piston extends during axial travel and has reached its rear position; said piston having radial passages on said rear end portion thereof and spaced axially from a rear end of the piston for providing communication between said rear chamber and said blind axial bore when the piston nearly reaches its forward position thereof during a working stroke, said radial passages being disposed in said rear extension when said piston reaches its rear position during said working stroke; said rear extension having an axial length thereof of larger diameter than the remainder thereof disposed at a remote axial position spaced axially from said rear chamber for providing communication between said radial passages and said forward chamber to externally of said casing and thereby to atmospheric pressure when said piston reaches said rear position; whereby application of said gaseous fluid under pressure into said rear chamber moves said piston toward said front end to impact said front end and gaseous fluid enters said front chamber as said piston nears its forward position and returns the piston toward its rear position and said piston is cyclically reciprocated and intermittently impacts said front end for driving a rod-like element axially.

2. A pneumatic impact device for driving rod-like elements axially individually according to claim 1, in which said clamp comprises means removably fixable on to said casing for releasably engaging a rod-like element when fixed on said casing for driving it axially.

* * * * *